US011207238B2

(12) United States Patent
Sakato

(10) Patent No.: US 11,207,238 B2
(45) Date of Patent: Dec. 28, 2021

(54) METHOD FOR CAUSING RELAXATION OF A MUSCLE AND A SYSTEM FOR ASSISTING A PERSON IN EXECUTING THE SAME METHOD

(71) Applicant: PACURE, INC., Tokyo (JP)

(72) Inventor: Takashi Sakato, Tokyo (JP)

(73) Assignee: PACURE, INC., Tokyo (JP)

( * ) Notice: Subject to any disclaimer, the term of this patent is extended or adjusted under 35 U.S.C. 154(b) by 343 days.

(21) Appl. No.: 15/892,971

(22) Filed: Feb. 9, 2018

(65) Prior Publication Data

US 2018/0235835 A1 Aug. 23, 2018

(30) Foreign Application Priority Data

Feb. 17, 2017 (JP) ..... JP2017-027550

(51) Int. Cl.

| | |
|---|---|
| ***A61H 39/02*** | (2006.01) |
| ***A61H 39/04*** | (2006.01) |
| ***A61H 23/06*** | (2006.01) |
| ***A61H 7/00*** | (2006.01) |

(52) U.S. Cl.

CPC ..... *A61H 39/02* (2013.01); *A61H 7/001* (2013.01); *A61H 23/06* (2013.01); *A61H 39/04* (2013.01); *A61H 2201/5061* (2013.01); *A61H 2201/5097* (2013.01)

(58) Field of Classification Search

CPC ..... A61H 39/02; A61H 7/001; A61H 23/06; A61H 39/04; A61H 2201/5061; A61H 2201/5097

USPC ..... 600/548

See application file for complete search history.

(56) References Cited

U.S. PATENT DOCUMENTS

| | | | | |
|---|---|---|---|---|
| 6,090,045 | A * | 7/2000 | Leahy | A61B 5/00 128/898 |
| 9,446,288 | B1 * | 9/2016 | Pazan | A61H 1/024 |
| 2016/0074234 | A1 * | 3/2016 | Abichandani | G05B 15/02 601/84 |
| 2016/0367433 | A1 * | 12/2016 | Leahy | G16H 20/30 |

FOREIGN PATENT DOCUMENTS

| | | | |
|---|---|---|---|
| JP | H08-033691 | A | 2/1996 |
| JP | 2007-014442 | A | 1/2007 |
| JP | 2009-050725 | A | 3/2009 |
| JP | 3152151 | U | 7/2009 |

(Continued)

OTHER PUBLICATIONS

Sakaguchi, Hirozumi et al., "The Effect of Kanshoho on the Low Back Pain (Lumbago).", Journal of Japanese Society for Integrative Medicine, vol. 5, No. 1, (2012).

*Primary Examiner* — Devin B Henson
*Assistant Examiner* — Joseph A Tombers
(74) *Attorney, Agent, or Firm* — Oliff PLC

(57) ABSTRACT

A method causes relaxation of a muscle of a body of a person or an animal. In a period in which a patient moves his or her body in a reciprocating manner to expand and contract the muscle, the patient or another person presses an arbitrary spot on the skin of the patient toward the muscle using a fingertip, for example. The pressing by the fingertip is controlled so that the area of the pressed spot on the skin falls within a range of 2 $cm^2$ to 0.1 $cm^2$ and the pressing force applied to the pressed spot falls within a range of 1 kgf to 100 gf.

7 Claims, 11 Drawing Sheets

(56) References Cited

FOREIGN PATENT DOCUMENTS

| | | | |
|---|---|---|---|
| JP | 2010-020161 | A | 1/2010 |
| JP | 2010-534110 | A | 11/2010 |
| JP | 2013-172841 | A | 9/2013 |
| JP | 2014-215563 | A | 11/2014 |

* cited by examiner

METHOD FOR CAUSING RELAXATION OF A MUSCLE AND A SYSTEM FOR ASSISTING A PERSON IN EXECUTING THE SAME METHOD

BACKGROUND

The present invention relates to a method for causing relaxation of a muscle of a person or an animal, and a system for assisting a person in executing the same method.

An action (hereinafter referred to as a "pressing treatment") of applying a pressing treatment (for example, a physical action such as pressing, stroking, massaging, or rubbing) to the tissue (for example, muscle) of the body of a person or an animal from a body surface with hands, a tool, or the like to cause a medically, healthily, or mentally beneficial effect on the body is widely known. For example, a pressing treatment generally called an acupressure or massage is known. Patent documents #1-#6 listed below respectively disclose a device and a tool for adjustment of the load of an acupressure, determination of appropriateness of the pressure of an acupressure, seeking of a trigger point of pain, detection of the degree of stiffness of a muscle portion, and acupressure simulation.

A muscle which occupies approximately 50% of a human body will be discussed as an example. Muscular tension can cause various bodily discomfort or diseases such as a low back pain, a stiff shoulder, arthralgia, poor circulation, migraine, and pollinosis. A pressing treatment called "Kanshoho" (a registered trademark in Japan) in the present specification is known as a method for relieving muscular tension (that is, causing relaxation of a tense muscle) (see a non-patent document #1 listed below). The Kanshoho is a method of applying appropriate pressing force to the muscle of a target from the body surface with fingers or the like while expanding and contracting the muscle to cause relaxation of the muscle.

Patent document #1: Japanese Patent Application Publication No. 2007-14442

Patent document #2: Japanese Patent Application Publication No. 2013-172841

Patent document #3: Japanese Patent Application Publication No. 2009-50725

Patent document #4: Japanese Patent Application Publication No. H08-33691

Patent document #5: Japanese Patent Application Publication No. 2014-215563

Patent document #6: Japanese Patent Application Publication No. 2010-20161

Non-patent document #1: Hirozumi Sakaguchi, et al., "The effect of Kanshoho on the low back pain (lumbago)", Journal of Japanese Society for Integrative Medicine, Vol. 5, No. 1, 2012, http://www.jho.or.jp/201203.pdf

SUMMARY

If health care providers and patients themselves learn the skills of practicing the Kanshoho correctly, it is expected that a large portion of diseases and bodily discomfort of many people will be reduced.

The Kanshoho is different from other pressing methods such as so-called acupressure or massage. However, conventionally, the skills of the Kanshoho are learnt through the experience of an expert who has years of experience. It is not easy for most people to learn the skills of the Kanshoho and be able to practice the same.

An object of the present invention is to allow persons to practice the pressing method for causing relaxation of muscles more easily.

According to an aspect of the present disclosure, a method for causing relaxation of a muscle of a body of a person or an animal includes: causing the person or the animal to perform a physical exercise of expanding and contracting the muscle; pressing one or more spots on a skin of the body toward a muscle under the skin while the physical exercise is being performed; and controlling the pressing on the respective spots so that an area of each of the pressed spots of the skin falls within a predetermined area range and a strength of a pressing force applied to each of the spots falls within a predetermined force range. The area range is between approximately 2 $cm^2$ and approximately 0.1 $cm^2$. The force range is between approximately 1 kgf and approximately 100 gf.

According to another aspect of the present disclosure, a system for assisting a user in executing a pressing treatment for causing relaxation of a muscle of a body of a person or an animal includes: at least one sensor sheet disposed between a pressing object operated by the user and a skin of the body; and an information processing system configured to be able to communicate with the at least one sensor sheet. The at least one sensor sheet has a number of sensor elements disposed at a number of two-dimensional positions on the sensor sheet. The sensor elements output pressing signals corresponding to the pressing applied from the pressing object to the respective positions. The information processing system receives the pressing signals from the sensor elements, and on the basis of the received pressing signals, specifies an area of each of one or more pressed spots on the sensor sheet, specifies a magnitude of the pressing force applied to each of the pressed spots, determines whether the area of each of the pressed spots falls within a predetermined area range, determines whether the pressing force at each of the pressed spots falls within a predetermined force range, and notifies the user of determination results. The area range is between approximately 2 $cm^2$ and approximately 0.1 $cm^2$. The force range is between approximately 1 kgf and approximately 100 gf.

DETAILED DESCRIPTION OF THE EMBODIMENT

Hereinafter, exemplary one or more embodiments of a method for causing relaxation of a muscle and a device for assisting a person in executing the method, based on the Kanshoho will be described with reference to the drawings.

It is generally thought that accumulation of wastes in muscles and an excess of calcium is one of the major causes of muscular tension. An object of the Kanshoho is to accelerate elimination of wastes in muscles and unnecessary calcium outside the muscles in order to cause relaxation of tense muscles. Here, a schematic structure of a muscle (particularly, a skeletal muscle) and the principle of the Kanshoho will be described briefly with reference to FIGS. 1 to 3.

Figure 1:
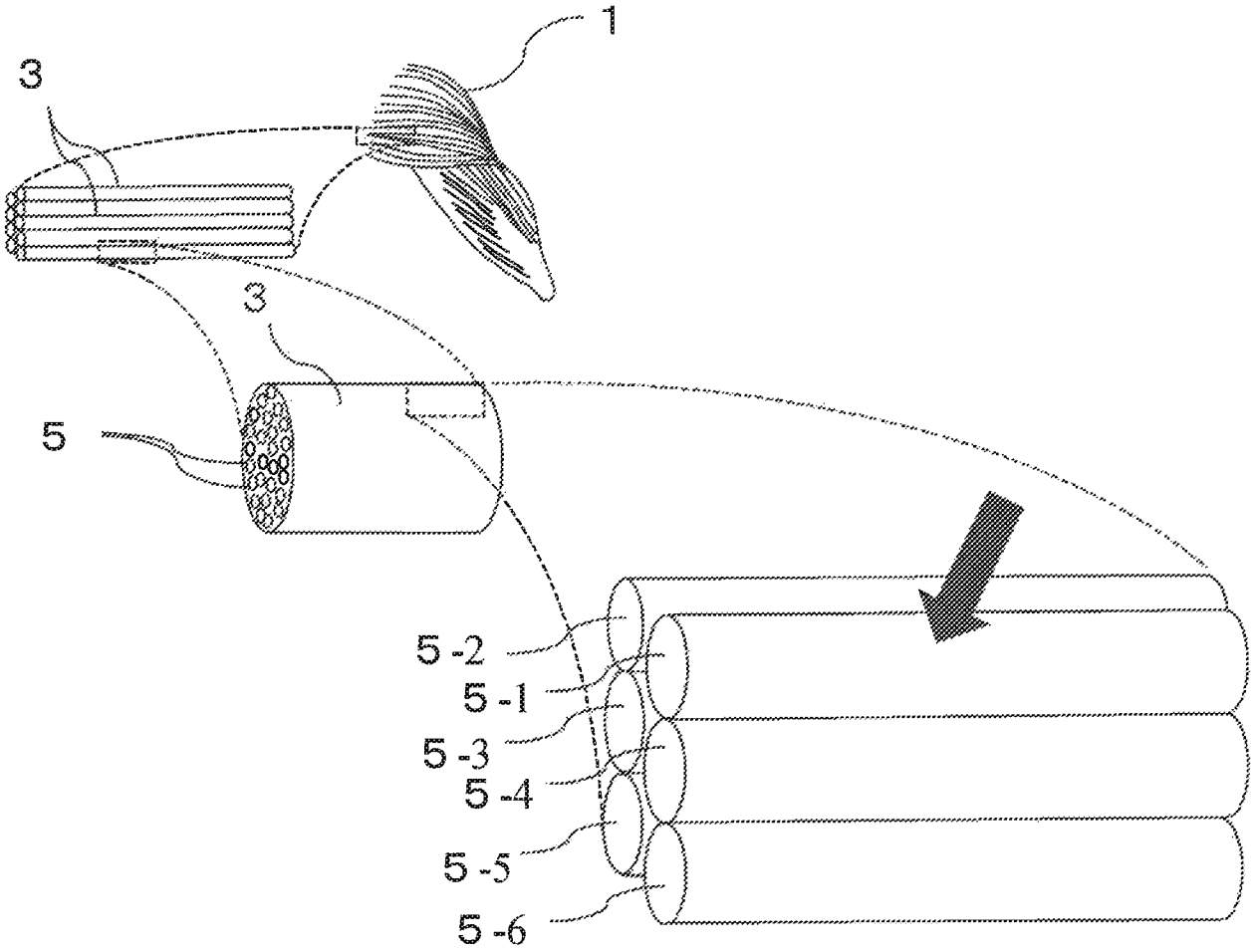
FIG. 1 illustrates a schematic structure of a muscle.

As illustrated in FIG. 1, a muscle (particularly, a skeletal muscle) 1 of a person or an animal is a group of many muscular fibers 3 and each muscular fiber 3 is a columnar multinucleated cell. A bundle of approximately 900 myofibrils 5 is present in each muscular fiber 3.

FIG. 1 illustrates six myofibrils 5-1 to 5-6 at an enlarged scale. When these myofibrils 5-1 to 5-6 do not receive any resistance, if the muscle 1 is moved (that is, the muscular fiber 3 is expanded and contracted), all the myofibrils 5-1 to 5-6 move uniformly and a relative movement between the myofibrils 5-1 to 5-6 occurs less easily. In contrast, it is assumed that the muscle 1 is moved in a state in which an appropriate pressing force is applied to one point of the bundle of myofibrils 5-1 to 5-6 as indicated by an arrow. By doing so, although some pressed myofibrils (for example, one myofibril 5-1) stop moving at that pressing point, the other myofibrils 5-2 to 5-6 move without stopping. In this way, the movement of the myofibrils 5-1 to 5-6 in the muscular fiber 3 is not uniform and a relative movement between the myofibrils 5-1 to 5-6 occurs. The relative movement between the myofibrils 5-1 to 5-6 accelerates elimination of wastes and unnecessary calcium accumulated between the myofibrils 5-1 to 5-6, and as a result, the tense muscle 1 is relaxed. This is the basis principle of the Kanshoho.

Figure 2:
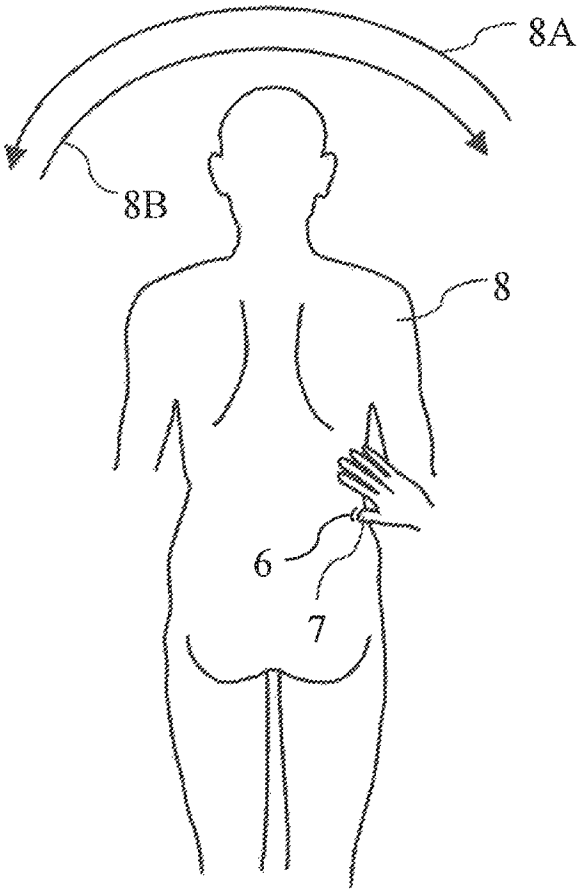
FIG. 2 illustrates how a treatment is performed when a muscle relaxation method according to an embodiment based on the Kanshoho is applied to the muscle of a patient's waist.

In a muscle relaxation method based on the Kanshoho according to an embodiment, as illustrated in FIG. 2, a therapist or a patient himself or herself presses an arbitrary spot 7 of the muscle of a patient from the top of a skin (or a clothing of a thin fabric on the skin) with a fingertip 7 (or a tool instead of the fingertip such as a narrow stick). A physical exercise which uses the pressed muscle is repeated so that the patient expands and contracts the muscle while maintaining the pressing state. For example, as illustrated in FIG. 2, when the external oblique muscle of the waist is expanded and contracted, an exercise of bending the waist so that an upper body 8 is tilted in the left-right direction as indicated by arrows 8A and 8B is repeated.

While the muscle expanding and contracting exercise is being repeated, the therapist pressing the muscle with the fingertip 7 controls a pressing state of the fingertip 7 (particularly, an area (a pressed area) of one pressed spot of the skin and a pressing force applied to the pressed spot) so as to be within a specific range to thereby create a state (that is, a relative movement between muscular fibers) in which some muscular fibers under the pressed spot stop moving in the expanding and contracting direction and the other muscular fibers move in the expanding and contracting direction. Furthermore, even when the orientation and the position of the body of the patient change with the movement of the muscle, the therapist controls the state of the fingertip 7 so that the position of the pressed spot of the muscle and the direction of the pressing force are maintained to be constant and the pressing state of the body (particularly, the pressed area and the pressing force applied to the pressed area) are continuously maintained within an appropriate range.

When the pressing treatment is applied to a certain spot on a skin, a muscle portion under the pressed spot is relaxed. When the pressing treatment is sequentially applied to many successive different spots covering a certain wide region on the skin, a large muscle portion covering the wide region is relaxed.

Figure 3B:
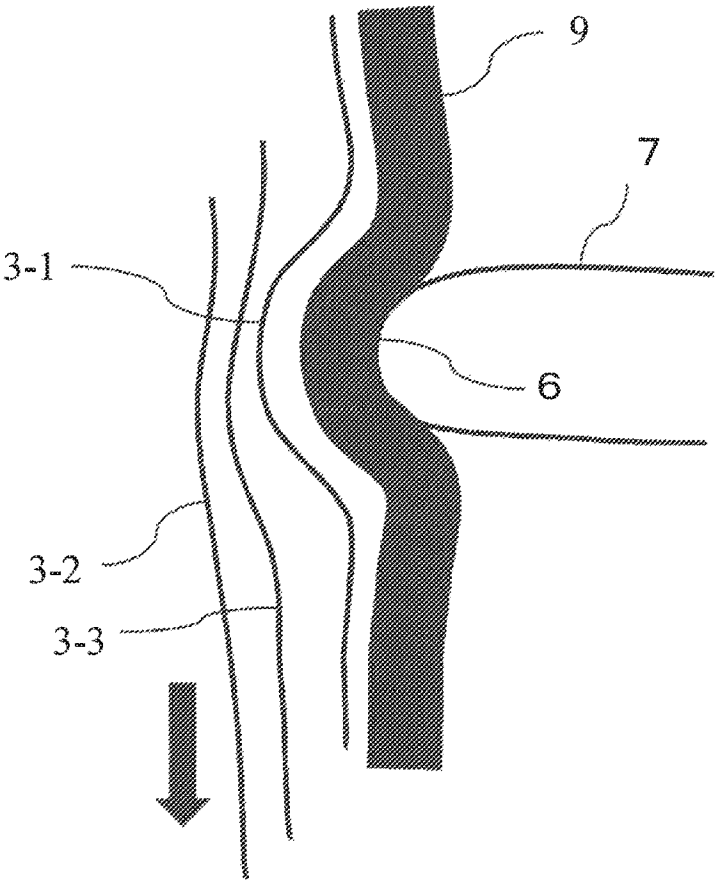
FIG. 3B illustrates a state in which muscular fibers move in relation to each other when the muscle is expanded and contracted in the pressing state.
Figure 3A:
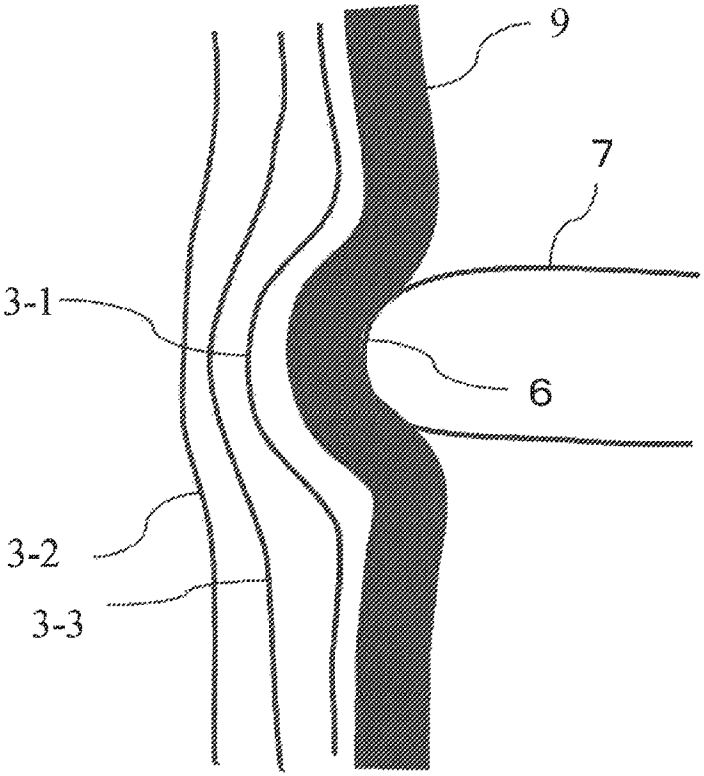
FIG. 3A illustrates a state in which muscular fibers are deformed when a muscle is pressed with a fingertip from the top of a skin.

It is supposed that the following is a mechanism in which a muscle is relaxed by the pressing treatment. As illustrated in FIG. 3A, when the fingertip 7 presses a certain spot (a small region) 6 on the surface of the skin 9, muscular fibers 3-1, 3-2, and 3-3 corresponding to the pressed spot 6 are deformed. When muscles are expanded and contracted while maintaining the pressing state of the fingertip 7 so as to satisfy specific conditions to be described later, as illustrated in FIG. 3B, a certain muscular fiber 3-3 moves relatively long distances in the expanding and contracting direction (the direction indicated by an arrow in the drawing), another certain muscular fiber 3-2 moves relatively short distances, and still another muscular fiber 3-1 is restricted from moving due to pressing. Therefore, a relative movement between these muscular fibers 3-1, 3-2, and 3-3 occurs. By doing so, a relative movement between several hundreds of myofibrils occurs in each of these muscular fibers 3-1, 3-2, and 3-3. It is supposed that the relative movement between myofibrils accelerates elimination into blood vessels, of wastes and unnecessary calcium accumulated between myofibrils.

From a viewpoint of accelerating elimination into blood vessels, of wastes and unnecessary calcium between myofibrils, the exercise of expanding and contracting the pressed muscles may be repeated at periods synchronized with the beats of the heart. For example, an exercise of expanding a pressed muscle (for example, an exercise of tilting the upper body 8 to the left side as indicated by the arrow 8A in FIG. 2) may be performed for a period (for example, approximately 2 seconds) corresponding to two heartbeats, and an exercise of contracting a pressed muscle (for example, an exercise of tilting the upper body 8 to the right side as indicated by the arrow 8B in FIG. 2) may be performed for a period (for example, approximately 2 seconds) corresponding to two heartbeats. That is, a reciprocating exercise of expanding and contracting the muscle may be performed at periods (for example, approximately 4 seconds) corresponding to four heartbeats.

Figure 4:
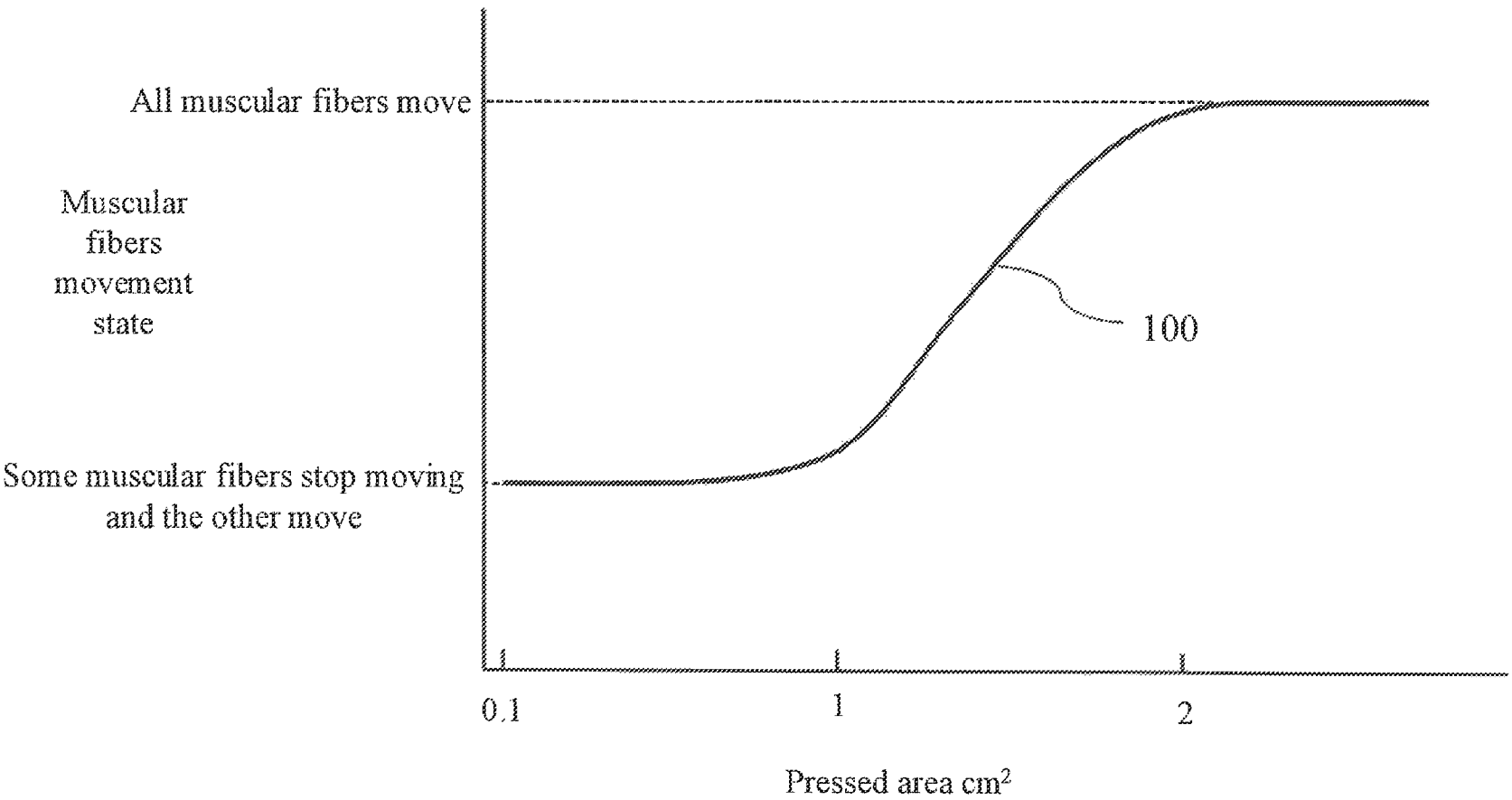
FIG. 4 illustrates an examination result of the relationship between a pressed area and a moving state of muscular fibers.
Figure 5:
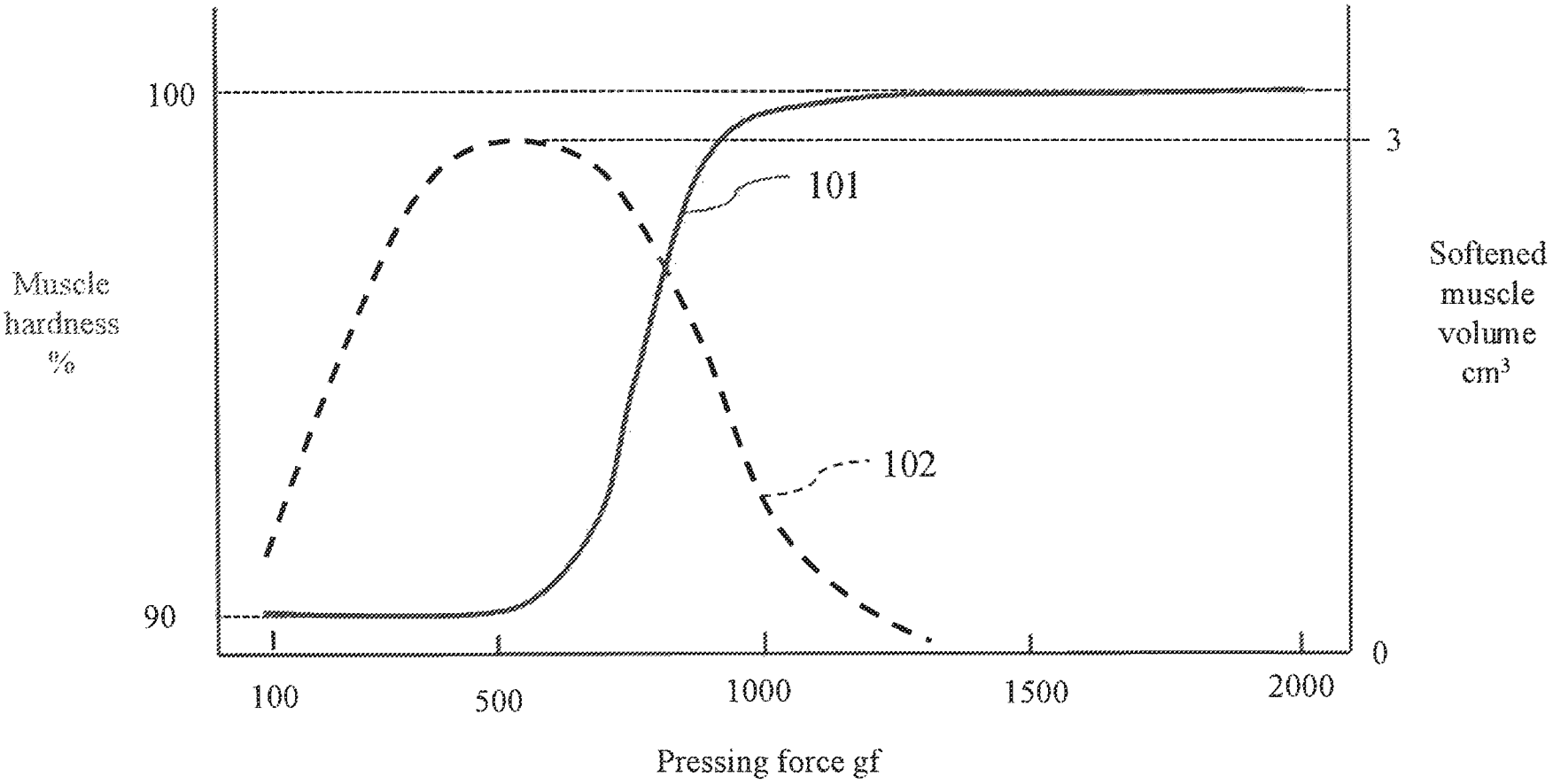
FIG. 5 illustrates an examination result of the relationship between a pressing force and the muscle relaxation effect.

The inventor of the present invention conducted the treatment of the Kanshoho-based muscle relaxation method on approximately 300 persons for 1200 hours in total for approximately 4 hours per person. Through this treatment, the relationship between pressing conditions (particularly, an area of one pressed spot (that is, a pressed area) and a pressing force applied to the pressed spot) and the muscle relaxation effect was examined. FIGS. 4 and 5 illustrate the results of the examination.

FIG. 4 illustrates the examination result of the relationship between a pressed area and a movement of muscular fibers. In this examination, the patient repeatedly moved his or her body to expand and contract the muscle in a state in which the inventor pressed a certain point of the skin of the patient toward a muscle with a fingertip. In this case, the area (a pressed area) of the spot of the skin pressed by the fingertip was changed in multiple steps from approximately 0.1 $cm^2$ to approximately 2.5 $cm^2$. Moreover, for each pressed area, the state of movement in the expanding and contracting direction, of a number of muscular fibers present at the end of the fingertip (that is, whether all muscular fibers were moving uniformly, or some muscular fibers stopped moving and the other muscular fibers were moving) was examined. The moving state of muscular fibers was determined by the feeling of the fingertip of the inventor. The inventor has studied the Kanshoho for 10 years or longer and has trained the feeling of the fingertip very sensitively, and could clearly sense whether the respective muscular fibers have moved or not.

From the examination result, it was found that as indicated by a curve 100 in FIG. 4, when the pressed area was approximately 1 $cm^2$ or less, a state in which some muscular fiber under the pressed spot stopped moving and another muscular fiber moved (this is a state in which the principle of the Kanshoho works and will be referred to as a first state) occurred. On the other hand, it was found that when the pressed area was approximately 2 $cm^2$ or more, a state in which all muscular fibers under the pressed spot moved uniformly (this is a state in which the principle of the Kanshoho does not work and will be referred to as a second state) occurred. When the pressed area was between approximately 1 $cm^2$ and approximately 2 $cm^2$, it was not possible to determine which one of the two states would occur (that is, the first state or the second state occurred depending on a situation). When the pressed area was approximately 1.5 $cm^2$ or less, the first state occurred with high probability.

FIG. 5 illustrates the examination result of the relationship between a pressing force and the muscle relaxation effect. In this examination, a treatment was conducted such that a patient moves his or her body to expand and contract the muscle in a state in which the inventor pressed a certain point of the skin of a patient toward a muscle with a fingertip. This treatment was conducted for 5 minutes as one session and a number of sessions were conducted. During one session, the pressed area was maintained to be approximately 1 $cm^2$ or less and the strength of the pressing force was maintained constant. Different strengths of the pressing force were applied to different sessions. The different segments of the pressing force were changed in multiple steps from 2 kgf to 100 gf. In each session, the hardness of the muscle under the pressed spot was measured by a muscle hardness meter immediately before and after the treatment. Furthermore, in each session, the inventor examined the hardness of the muscle under the pressed spot with the fingertip immediately before and after the treatment. In this way, a three-dimensional volume (the product of an area and a depth) of the muscle which was determined to be softer (that is, more relaxed) immediately after the treatment than before the treatment was schematically specified in each session.

In FIG. 5, the vertical axis on the left side indicates an average value of the muscle hardness immediately after the session, which is represented by the percentage (%) of the muscle hardness immediately after the session with respect to the muscle hardness (100%) immediately before the session. A curve 101 indicates the relationship between the pressing force and the muscle hardness. The vertical axis on the right side indicates a schematic volume of the muscle softened (relaxed) by the session. A curve 102 indicates the relationship between the pressing force and the volume of the softened muscle.

As can be understood from the curve 101 in FIG. 5, when the pressing force applied to the pressed area was approximately 500 gf or less, a muscle softening (relaxation) effect of approximately 10% on average was obtained by 5 minutes of treatment. When the pressing force was more than 500 gf, it was found that the larger the pressing force, the smaller the muscle relaxation effect. When the pressing force was 1 kgf or more, even when the treatment was performed for 5 minutes, there was substantially no muscle softening (relaxation) effect.

As can be understood from the curve 102 in FIG. 5, when the pressing force applied to the pressed area was approximately 500 gf, the volume of the muscle under the pressed spot, softened (relaxed) by 5 minutes of treatment was approximately the largest (approximately 3 $cm^3$). When the pressing force was lower or higher than approximately 500 gf, the volume of the softened (relaxed) muscle was smaller than the largest volume. However, it was found that, when the pressing force was near approximately 500 gf (for example, between approximately 600 gf and approximately 400 gf or between approximately 700 gf and approximately 300 gf), the volume of the softened muscle was substantially the largest. Since the larger the volume of the softened muscle, the smaller the number of times (the number of pressed spots) of the treatment that has to be performed to relax a wide region of the muscle, the efficiency of treatment increases as the volume increases. When the pressing force was more than approximately 1 kgf, since the volume of the softened muscle reached approximately zero, it was thought that there was substantially no treatment effect.

In this examination, the muscle relaxation effect when 5 minutes of treatment was conducted in a state in which the pressed area was approximately 2 $cm^2$ or more (as illustrated in FIG. 4, all muscular fibers have moved) was also examined. As a result, in such a wide pressed area, substantially no muscle relaxation effect was obtained regardless of the strength of the pressing force.

In this examination, a difference in the muscle relaxation effect when an exercise (for example, the physical exercise indicated by the arrows 8A and 8B in FIG. 2) of expanding and contracting the muscle in a state in which the muscle was pressed was repeated at different periods was also examined. As a result, the muscle relaxation effect when the period of each of the exercises of expanding and contracting the muscle was shorter than 1 seconds and was longer than 3 seconds was lower than that when the period was approximately 2 seconds. Therefore, it was determined that it was appropriate for many people to repeat an exercise of expanding the muscle for approximately 2 seconds (that is, every two heartbeats) and contracting the muscle for approximately 2 seconds (that is, repeating a physical reciprocating exercise at periods of approximately 4 seconds).

From the examination results, an effect that the muscle is relaxed can be obtained when during the treatment of the muscle relaxation method, the pressed area falls within an area range indicated by (1) below and the pressing force applied to the pressed area falls within a force range indicated by (2) below.

(1) Area Range:

(A) Between approximately 2 $cm^2$ and approximately 0.1 $cm^2$;

(B) Between approximately 1.5 $cm^2$ and approximately 0.1 $cm^2$; or (C) Between approximately 1 $cm^2$ and approximately 0.1 $cm^2$.

(2) Force Range:

(A) Between approximately 1 kgf and approximately 100 gf;

(B) Between approximately 700 gf and approximately 100 gf;

(C) Between approximately 500 gf and approximately 100 gf;

(D) Between approximately 500 gf and approximately 300 gf;

(E) Between approximately 500 gf and approximately 400 gf;

(F) Between approximately 700 gf and approximately 300 gf;

(G) Between approximately 600 gf and approximately 400 gf; or (H) Within near approximately 500 gf.

Strictly speaking, even when the pressed area and the pressing force are controlled to be within a constant range, the muscle relaxation effect is different depending on an individual difference, the degree of tension, a body region, and a difference in other muscle states. However, if the pressed area is between approximately 1 $cm^2$ and 0.1 $cm^2$ and the pressing force applied to the area is between approximately 500 gf and approximately 100 gf, it is highly likely that a muscle relaxation effect is obtained by approximately 5 minutes of treatment with respect to most of the usual states of muscles. Furthermore, the pressing force applied to the pressed area may be controlled to be within a narrower range closer to approximately 500 gf (for example, between approximately 500 gf and approximately 300 gf).

It is not easy for an ordinary person to learn a skill of executing a pressing treatment which satisfies both conditions of (1) and (2). It is more difficult to continuously satisfy both conditions in a state in which a patient is moving the muscles (the body).

Figure 6:
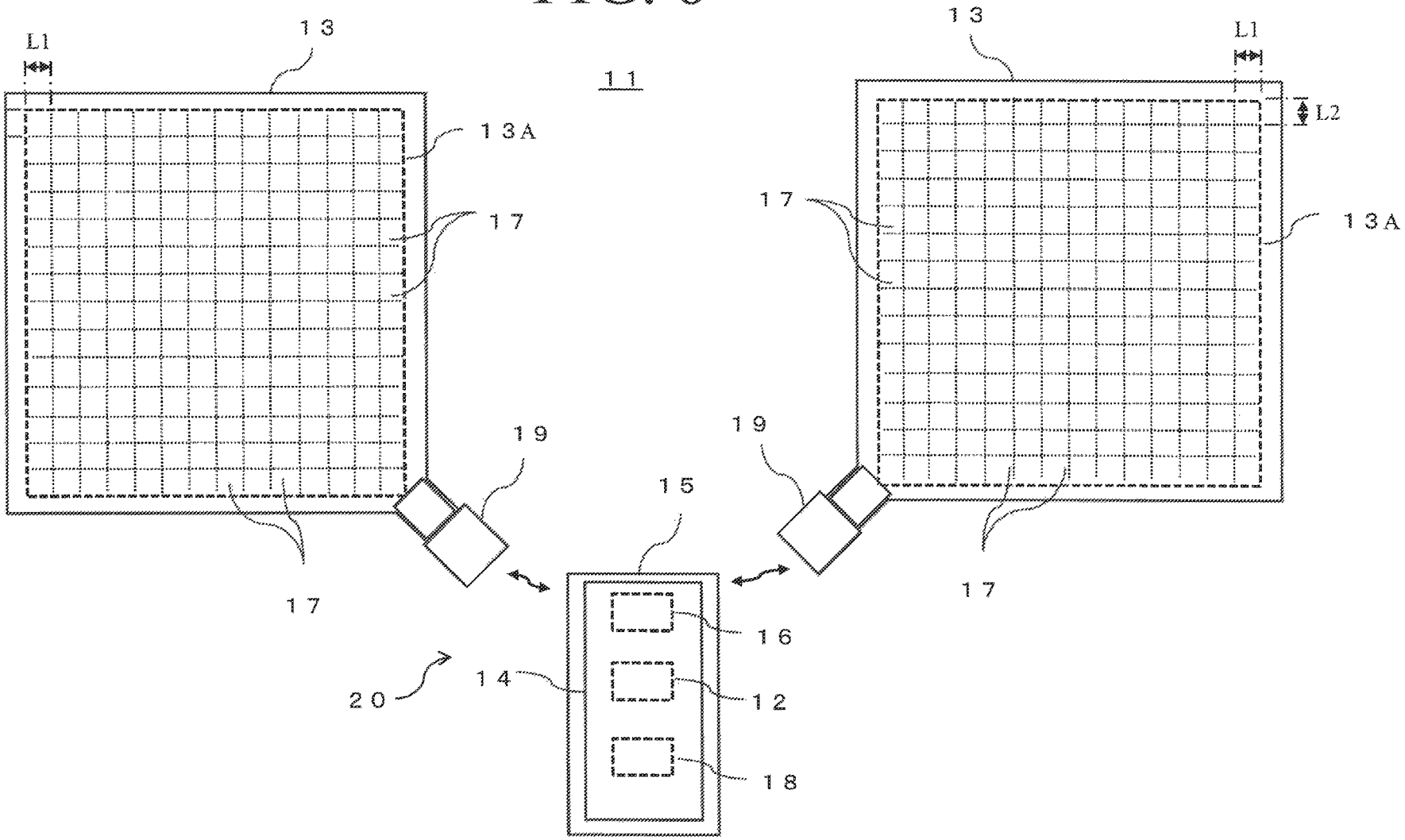
FIG. 6 is a general view of an assistance system according to an embodiment.

FIG. 6 illustrates a general view of a device that assists a person in executing the pressing method according to another embodiment. This assistance system can be used when a therapist presses the body of a patient and when the patient himself or herself presses his or her body.

As illustrated in FIG. 6, an assistance system 11 includes one or more sensor sheets 13 and a display device 15. The display device 15 can communicate with the respective sensor sheets 13 via cables or wirelessly. Each sensor sheet 13 has a function of detecting a pressing state in a region covered by the sensor sheet 13 (that is, the level of a pressing force at a number of positions within the region). The display device 15 has a function of evaluating the pressing states detected by the respective sensor sheets 13 and displaying or notifying the user of the pressing states and/or the evaluation results visually or audibly.

A user attaches the respective sensor sheets 13 to the surface of the skin of an arbitrary body region on which the pressing treatment is to be executed (for example, a lateral region of the left or right side of the waist, the left or right-side back region, and the like) and presses an arbitrary position of the region from the upper surfaces of the respective sensor sheets 13 with an arbitrary pressing object (for example, a fingertip, a distal end of a stick-shaped tool as narrow as a finger, and the like). In this way, the sensor sheet 13 is disposed between the body and the pressing object to detect the pressing state of the pressing applied from the pressing object to the body.

Only one sensor sheet 13 may be used when one region (for example, the right region of the waist) of the body is pressed. Two sensor sheets 13 may be used simultaneously when two separate regions (the right and left regions of the waist) of the body are pressed simultaneously. A larger number of sensor sheets 13 may be used simultaneously. When a plurality of sensor sheets 13 are used simultaneously, the display device 15 can communicate with the plurality of sensor sheets 13 simultaneously and process and display the pressing states detected by the sensor sheets 13 simultaneously.

The sensor sheet 13 is a sheet that is thin (for example, a thickness of approximately several mm or less), wide, and flexible, and that is at least partially formed using a flexible material (for example, silicon rubber or the like) that can be deformed easily. The sensor sheet 13 may have flexibility that is equal to or higher than a biological tissue ranging from the skin to muscles of the body so as not to be resistant to the pressing on the body.

The planar shape of the sensor sheet 13 may be a square shape or may be a rectangular shape, a circular shape, or other arbitrary shapes (for example, a shape that fits to the waist, the shoulder, or other regions of the body). The area of the sensor sheet 13 may be larger than the area of any one of the area ranges discussed above and may be such a size that it is convenient to attach the sheet to a pressing region (for example, between approximately 4 $cm^2$ and approximately 1000 $cm^2$). One surface of the sensor sheet 13 may be an adhesive function such that the sheet is easily attached to the surface of the body skin.

The sensor sheet 13 has a number of sensor elements 17 (segments partitioned by dot lines in FIG. 6). These sensor elements 17 are disposed at a number of two-dimensionally successive positions (for example, positions arranged in a matrix form) in a main region 13A of the sensor sheet 13. Each sensor element 17 outputs an electrical signal (a pressing force signal) corresponding to the level of the pressing force applied thereto. The area of each sensor element 17 is sufficiently smaller than the area (for example, 1 $cm^2$) of anyone of the above-described area ranges. For example, a lateral dimension L1 and a vertical dimension L2 of each sensor element 17 are between an approximately millimeter order to an approximately micron order. The finer the sensor element 17, the higher spatial resolution with which the pressing state can be detected.

The sensor sheet 13 has a signal processing device 19. The signal processing device 19 can communicate with a number of sensor elements 17 and drives the sensor elements 17, receives pressing force signals from the sensor elements 17, processes the pressing force signals to convert the same to sensing data of a predetermined format, and transmits the sensing data to the display device 15. The signal processing devices 19 of one or more sensor sheets 13 and the display device 15 that can communicate with the signal processing devices 19 form an information processing system 20.

The power of the sensor sheet 13 may be supplied from a battery (not illustrated) mounted on the sensor sheet 13 or an external power supply device (not illustrated) or the display device 15.

The display device 15 may be a special device designed for the pressing assistance system 11 and may be a general-purpose information processing device (for example, a smartphone, a cellular phone, a tablet terminal, or a personal computer) in which an application program for the pressing assistance system 11 executed by an internal CPU 12 is installed and the application program can be executed by the internal CPU 12. The display device 15 receives sensing data from one or more sensor sheets 13 being used and processes the sensing data to thereby create pressing state data indicating the pressing states (a pressing force distribution that correlates the position of the pressed sensor element 17 and the detected pressing force) of the respective sensor sheets 13 and/or pressing evaluation data indicating the evaluation result (for example, the degree in which the pressing state matches the force range and the area range (that is, the degree of appropriateness of pressing (a plurality of steps of levels or scores))) of the respective pressing states on a real-time basis. The display device 15 has a display screen 14 and/or a speaker 16 and can display the pressing state data and/or the pressing evaluation data of the respective sensor sheets 13 on the display screen 14 visually on a real-time basis and/or output the same (particularly, the pressing evaluation data) from the speaker 16 audibly on a real-time basis.

The user can receive the pressing state data or the pressing evaluation data displayed or output on the display device 15 while pressing the body of the patient and determine the appropriateness of the pressing treatment and correct the pressing treatment. In this way, the user can learn and execute an appropriate pressing method more easily.

The display device 15 may have a function of displaying the pressing state data and/or the pressing evaluation data of the plurality of sensor sheets 13 on the display screen 14 simultaneously in comparison when the plurality of sensor sheets 13 are used simultaneously and/or outputting the same from the speaker 16 (for example, the tone may be changed for respective sensor sheets 13 so that the sensor sheets can be distinguished by the sound).

By using this function, the user can specify the pressing states of the two regions of the left and right sides of the waist of a person, for example, while pressing the two regions simultaneously. Alternatively, a beginner can observe the pressing state in comparison with that of a skilled person while the beginner presses the left side of the waist of a person and the skilled person presses the right side of the waist of the person. In this way, the beginner can learn the skill of the skilled person more easily.

The display device 15 has a storage 18 and the past pressing state data and/or the past pressing evaluation data may be stored in the storage 18. The display device 15 may have a function of displaying the data on the display screen 14 as an image simultaneously with and in comparison with the real-time pressing state and/or the pressing evaluation data and/or outputting the same from the speaker 16 as sound (for example, the tone may be changed for respective sensor sheets 13 so that the sensor sheets can be distinguished by the sound).

By using this function, a beginner can observe his or her real-time pressing state while reproducing the pressing state data and/or the pressing evaluation data of the skilled person stored in the storage 18 and comparing the pressing state with the reproduced data. In this way, the beginner can learn the skill of the skilled person more easily.

The display device 15 may have a function of visually or audibly outputting an instruction (for example, prepared in advance and stored in the storage 18) related to a muscular (physical) exercise, starting and stopping of pressing, changing of a pressed spot, and/or checking of a muscular flexibility while displaying or outputting the pressing state and the like on a real-time basis. When the Kanshoho is executed, an exercise of expanding and contracting muscles (for example, swinging of the upper body of the waist) at a speed of approximately one reciprocation in 4 seconds, for example. Moreover, after a muscle expanding and contracting exercise is performed a number of times while continuing the pressing, the pressing is stopped temporarily and then, the pressing and the muscular exercise are performed again. Alternatively, the same treatment is repeated while changing the pressing position. After such a treatment is performed for several minutes, the flexibility of muscles may be checked. When the display device 15 provides an instruction for performing such operations to the user, the user can learn and practice the Kanshoho more easily and appropriately.

Figure 7:
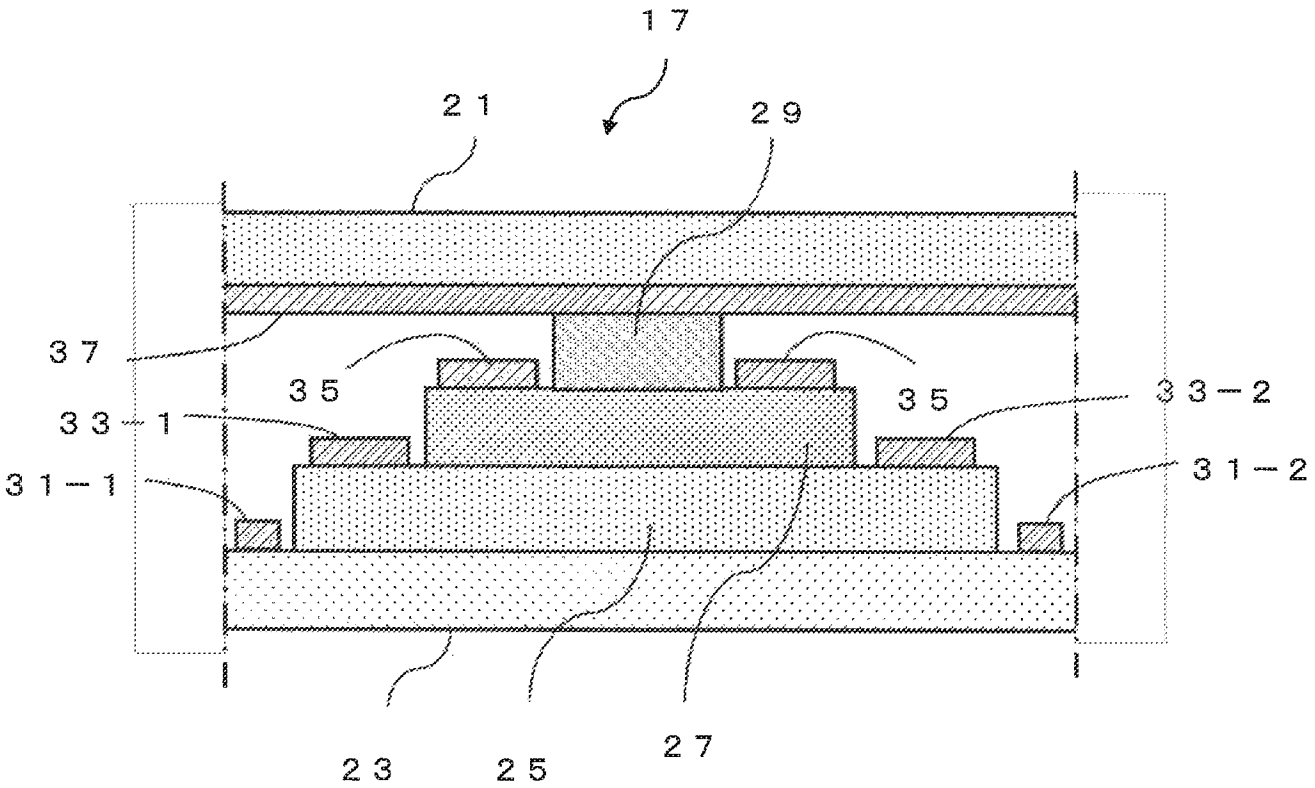
FIG. 7 illustrates a cross-sectional structure in a thickness direction of one sensor element in a sensor sheet of the system.

FIG. 7 illustrates an example of a cross-sectional structure in the thickness direction of each sensor element 17 in the sensor sheet 13.

As illustrated in FIG. 7, the sensor element 17 is formed between an upper sheet 21 and a lower sheet 23 that form the upper and lower surfaces of the sensor sheet 13, respectively. The upper sheet 21 is a sheet that receives the pressing of a finger, for example. On the other hand, the lower sheet 23 is a sheet that makes contact with the surface of the body skin, for example, and a layer (not illustrated) having an adhesive function for attachment to the skin may be formed on the lower surface thereof. The relationship of the upper sheet 21 and the lower sheet 23 may be reversed.

A plurality of layers of elastic sheets are formed on the lower sheet 23 (although three layers are formed in the present embodiment, two or four or more layers may be formed). For example, a lower elastic sheet 25, a middle elastic sheet 27, and an upper elastic sheet 29 are provided in a superimposed manner. These elastic sheets 25, 27, and 29 have areas such that the lower layer has a larger area than the upper layer and form a generally stepped pyramid.

A plurality of column electrodes 31-1, 31-2, 33-1, 33-2, and 35 are disposed on the horizontal surfaces of a plurality of steps of the stepped pyramid. That is, the column electrodes 31-1 and 31-2 are disposed on the surface of the lower sheet 23 on the outer side of the lower elastic sheet 25. The column electrodes 33-1 and 33-2 are disposed on the surface of the lower elastic sheet 25 on the outer side of the middle elastic sheet 27. Moreover, the column electrodes 35 are disposed on the surface of the middle elastic sheet 27 on the outer side of the upper elastic sheet 29.

A row electrode 37 is disposed on the lower surface of the upper sheet 21 so as to face the column electrodes 31-1, 31-2, 33-1, 33-2, and 35. The row electrode 37 and the column electrodes 31-1, 31-2, 33-1, 33-2, and 35 form switches. Each switch is normally in the OFF state and enters into the ON state upon receiving a certain magnitude of pressing force. A switch corresponding to a column electrode disposed on a lower layer is turned on upon receiving a larger pressing force than a switch corresponding to a column electrode disposed on an upper layer. Therefore, it is possible to detect the level of an applied pressing force by identifying a switch in the ON state.

Figure 9:
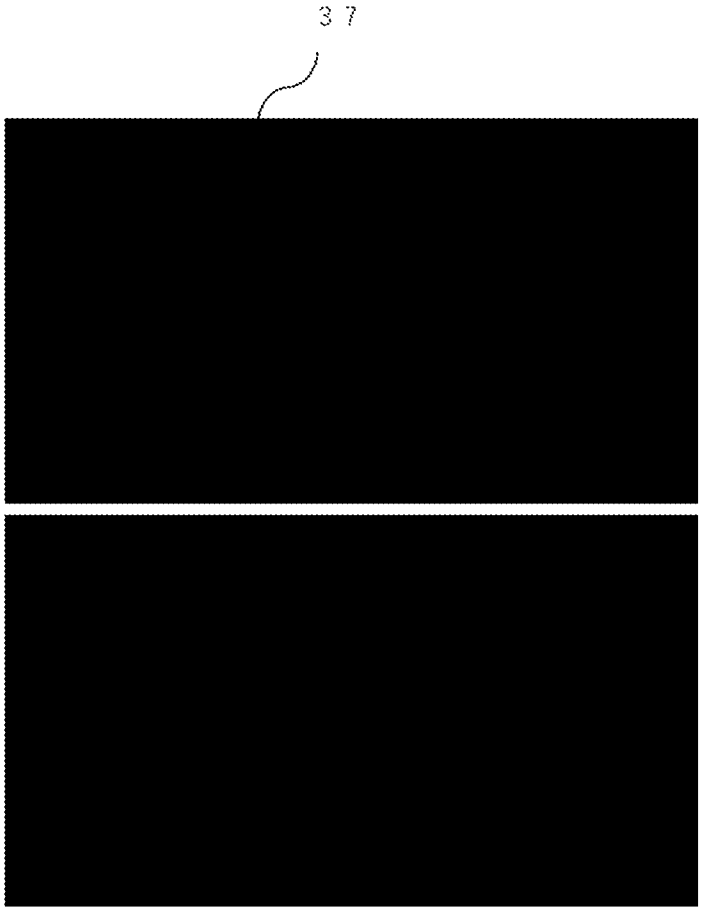
FIG. 9 illustrates an example of a planar design of row electrodes corresponding to FIG. 8.
Figure 8:
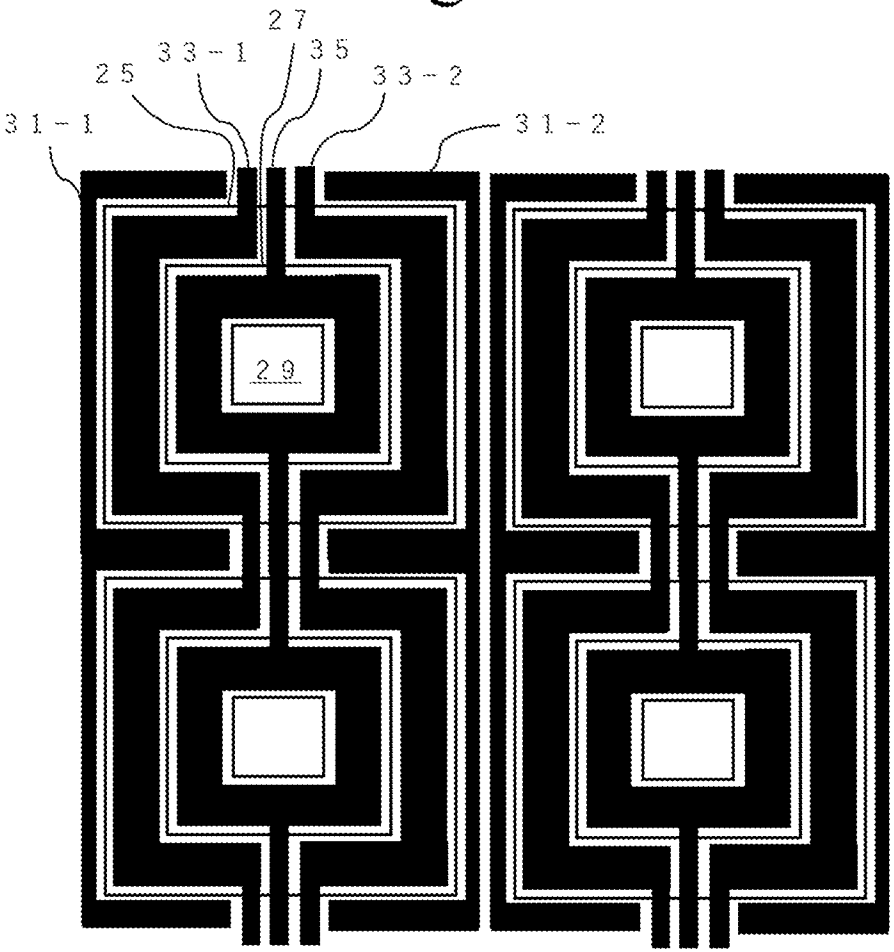
FIG. 8 illustrates an example of a planar design of column electrodes of adjacent four sensor elements.

FIG. 8 illustrates an example of a planar design of the column electrodes 31-1, 31-2, 33-1, 33-2, and 35. FIG. 9 illustrates an example of the design of the row electrode 37. FIGS. 8 and 9 illustrate a planar design of the column electrodes and the row electrodes of adjacent four sensor elements 17, and dark regions indicate electrodes. In the sensor sheet 13, the row electrode 37 illustrated in FIG. 9 is superimposed above the column electrodes 31-1, 31-2, 33-1, 33-2, and 35 illustrated in FIG. 8.

As illustrated in FIGS. 7 and 8, the column electrodes 31-1, 31-2, 33-1, 33-2, and 35 extend in a column direction (a direction vertical to the sheet surface of FIG. 7, that is, the up-down direction of FIG. 8) and are disposed so as to pass through the plurality of sensor elements 17 arranged in the column direction sequentially. Two column electrodes 31-1 and 31-2 passing through the same sensor element 17 may be electrically connected to each other and may be separated from each other. The column electrodes 33-1 and 33-2 passing through the same sensor element 17 may be electrically connected to each other and may be separated from each other. However, the column electrodes 31-1 and 31-2, the column electrodes 33-1 and 33-2, and the column electrodes 35 passing through the same sensor element 17 are electrically separated from each other. The column electrodes 31-1, 31-2, 33-1, 33-2, and 35 passing through each sensor element 17 are electrically separated from the column electrodes 31-1, 31-2, 33-1, 33-2, and 35 passing through another sensor element disposed at a different position in the row direction (the left-right direction of FIGS. 6 and 7).

As illustrated in FIGS. 7 and 9, the respective row electrodes 37 extend in the row direction (the left-right direction of FIGS. 7 and 9) and are disposed so as to pass through the plurality of sensor elements 17 arranged in the row direction sequentially. The row electrodes 37 passing through each sensor element 17 are electrically separated from the row electrodes 37 passing through another sensor element 17 disposed at a different position in the column direction (the direction vertical to the sheet surface of FIG. 7, that is, the up-down direction of FIG. 9).

As can be understood from FIGS. 7, 8, and 9, in one sensor element 17, when a downward pressing force is applied from the upper surface of the upper sheet 21, for example, the stepped pyramid formed by the plurality of layers of elastic sheets 25, 27, and 29 collapses downward by an amount corresponding to the pressing force according to the elasticity thereof. When the pressing force is removed, the pyramid restores its original shape. As a result, the plurality of switches formed by the row electrode 37 and the column electrodes 31-1, 31-2, 33-1, 33-2, and 35 are selectively turned on according to the pressing force.

That is, the switches corresponding to the column electrodes 35 are turned on when a predetermined low-level pressing force is applied. The switches corresponding to the column electrodes 33-1 and 33-2 are also turned on when a predetermined middle-level pressing force is applied. The switches corresponding to the column electrodes 31-1 and 31-2 are also turned on when a predetermined high-level pressing force is applied. Therefore, it is possible to know the level of the pressing force applied to the sensor element 17 by checking the ON/OFF states of switches in each sensor element 17.

All column electrodes 31-1, 31-2, 33-1, 33-2, and 35 and all row electrodes 37 are connected to the signal processing device 19 illustrated in FIG. 6. The signal processing device 19 performs a scanning operation of applying a voltage sequentially to a number of switches formed by combinations of the respective column electrodes 31-1, 31-2, 33-1, 33-2, and 35 and the row electrodes 37 at a high speed to detect switches in the ON state substantially on a real-time basis. The signal processing device 19 processes the detection result to create sensing data of a predetermined format and transmits the sensing data to the display device 15.

The signal processing performed by the signal processing device 19 is only converting a data format of the detection result to a predetermined format, and may be relative simple processing of outputting the detection result itself as the content of the sensing data. Alternatively, the signal processing may be relatively complex processing of analyzing the detection result, specifying a position (a sensor element 17) on the sensor sheet 13 to which the pressing force is applied and the level of pressing force applied to the position, and outputting the sensing data as the detected content.

Figure 10:
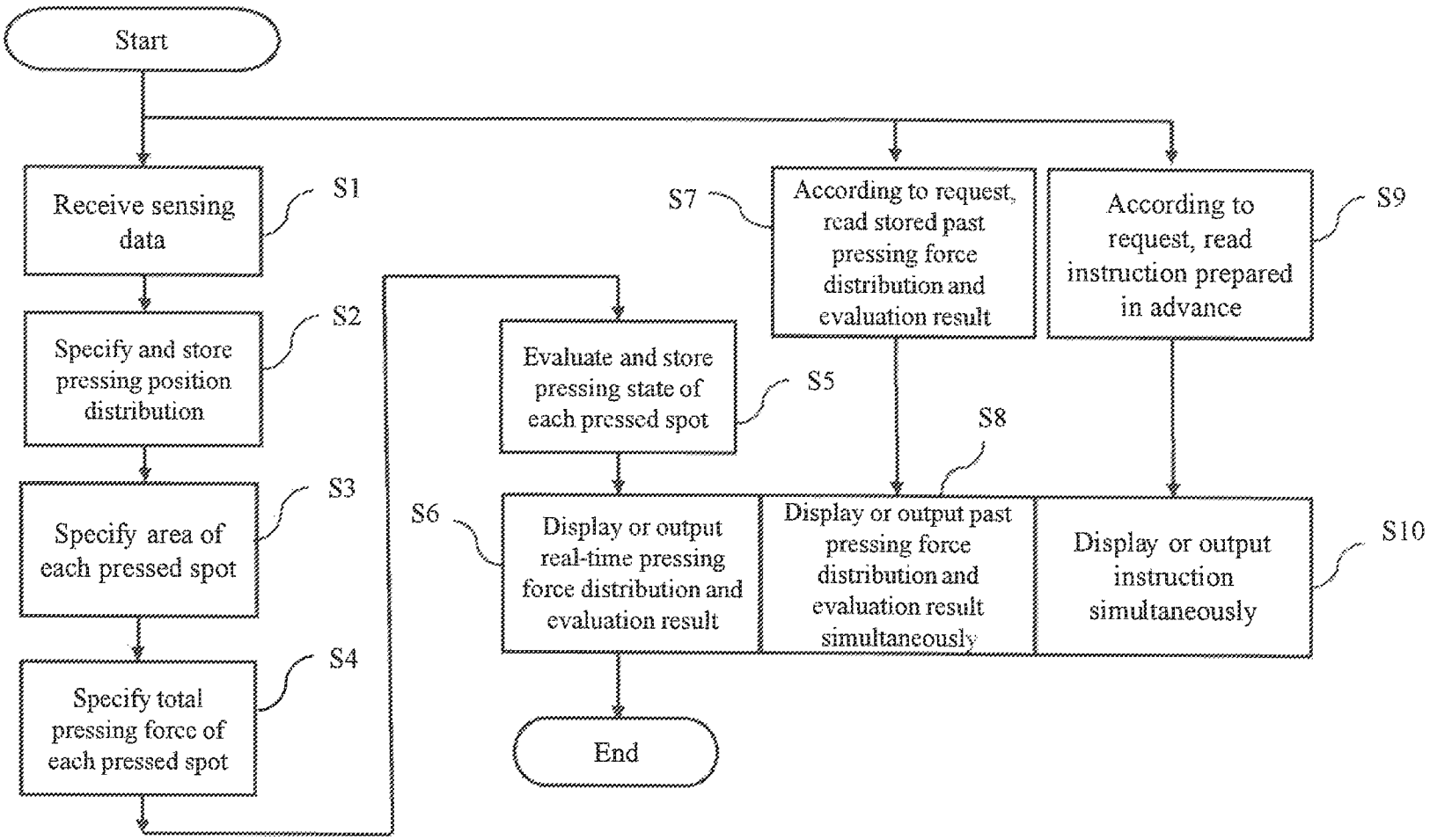
FIG. 10 illustrates a flow of a control process that a display device of the system performs (or an application program installed in the display device performs)

FIG. 10 illustrates the flow of a control process performed by the display device 15 (or performed by an application program installed in the display device 15).

As illustrated in FIG. 10, the display device 15 receives real-time sensing data from one or more sensor sheets 13 being used (step S1). Data that correlates a real-time pressing position distribution (that is, the respective positions of a number of sensor elements 17 of each sensor sheet 13) and the levels (for example, any one of the three steps of levels) of the pressing force detected at respective positions) with each other is specified on the basis of the sensing data obtained from the respective sensor sheets 13, and the pressing position distribution is stored in the storage 18 (step S2).

A real-time area of each pressed spot is specified on the basis of the pressing position distribution (step S3). Here, the pressed spot is a region in which a plurality of positions in which pressing force is detected are successively adjacent and gather and is a region on the sensor sheet (that is, substantially on the skin) pressed by the same pressing object (for example, one fingertip, one stick end or the like). The area (a pressed area) of the pressed spot is specified from the number of positions (sensor elements 17) in which the pressing force is detected and which gather in that region.

A real-time total pressing force applied to each pressed spot is specified (step S4). The total pressing force applied to each pressed spot is specified by adding up the pressing force at the positions gathering in the above-described region.

Subsequently, the pressing state (for example, the pressed area and the total pressing force) on each pressed spot is evaluated, and the real-time evaluation result is stored in the storage 18 in correlation with the sensing data processed in step S1 (step S5). In this evaluation, it is determined for each pressed spot whether the pressed area falls within one or more of the above-described area ranges and whether the total pressing force falls within one or more of the above-described force ranges. For example, a plurality of levels (for example, four levels) of determination results (that is, evaluation results) can be output as follows.

(1) Evaluation result level 4: "Pressing is excessively large"

The total pressing force applied to the pressed spot is more than 700 gf, or the area of the pressed spot is more than 1.5 $cm^2$.

(2) Evaluation result level 3: "Pressing is nearly appropriate but slightly excessively large"

The total pressing force applied to the pressed spot is 700 gf or less and more than 500 gf, or the area of the target pressed spot is 1.5 $cm^2$ or less and more than 1 $cm^2$.

(3) Evaluation result level 2: "Pressing is appropriate"

The total pressing force applied to the pressed spot is 500 gf or less and 300 gf or more, and the area of the target pressed spot is 1 $cm^2$ or less and more than 0.1 $cm^2$.

(4) Evaluation result level 1: "Pressing is excessively small"

The total pressing force applied to the target pressed spot is less than 300 gf, or the area of the target pressed spot is 0.1 $cm^2$ or less.

According to the evaluation method, it is determined that the pressing is appropriate if the area of the target pressed spot is between 1 $cm^2$ and 0.1 $cm^2$ and the total pressing force applied to the target pressed spot is between 500 gf and 300 gf. However, the above-described evaluation is an example for explanation only. Delicate evaluation with a larger number of steps (for example, scores ranging from 0 to 100) may be performed. Alternatively, tighter evaluation (for example, refined evaluation with a narrower range of appropriate pressing force and appropriate pressed area may be performed, and looser evaluation may be performed. Alternatively, the pressing force and the pressed area may be evaluated separately.

The total pressing force applied to the pressed spot may be evaluated using one or more pressing force references having a predetermined pressing force value selected from near 1 kgf, near 700 gf, and near 500 gf, for example. Moreover, the area (the pressed area) of the pressed spot may be evaluated using one or more pressed area references having a predetermined area value selected from near 2 $cm^2$, near 1.5 $cm^2$, and near 1 $cm^2$, for example. The appropriateness of the pressing state may be evaluated in a plurality of levels on the basis of these evaluation results. By doing so, it may be evaluated that it is an appropriate pressing state if the total pressing force applied to one pressed spot is between approximately 1 kgf and approximately 300 gf, between approximately 700 gf and approximately 300 gf, or between approximately 500 gf and approximately 300 gf, and the pressed area is approximately 2 $cm^2$ or less, approximately 1.5 $cm^2$ or less, or approximately 1 $cm^2$ or less.

The real-time positional distribution of the pressing force and the evaluation result specified in this manner are output in such a manner that the user can recognize the evaluation result and the distribution (step S6). As an output method, image information may be displayed on the display screen 14 and/or audio information may be output from the speaker 16.

The above-described control of steps S1 to S6 is repeated at a high speed. In this way, in a period in which the user performs a pressing treatment, the pressing state (for example, the positional distribution of the pressing force at each pressed spot and the evaluation result) is output to the display device 15 continuously and on a real-time basis. When a plurality of sensor sheets 13 are used simultaneously, the display device 15 may perform the control of S1 to S6 on the respective sensor sheets 13 and output the positional distributions of the pressing force and the evaluation results of the plurality of sensor sheets 13 simultaneously or selectively.

When a request is input from the user to the display device 15, the past pressing force distribution and the evaluation result stored in the storage 18 of the display device 15 are read simultaneously with the control of steps S1 to S6 (step S7) and are output simultaneously so as to be compared with the real-time pressing state output in step S6 (step S8).

When a request is input from the user to the display device 15, a predetermined instruction (for example, a visual, audible, or tactile instruction for guiding treatment such as a physical exercise for expanding and contracting muscles, starting and stopping of pressing and changing of a pressing position) stored in the storage 18 of the display device 15 is read simultaneously with the control of steps S1 to S6 (step S9) and is output simultaneously with the output of the real-time pressing state in step S6 (step S10). An example of the instruction is an audio signal for guiding execution of a physical exercise for expanding and contracting muscles at predetermined periods (for example, an audio signal repeatedly output every 2 seconds, for prompting a patient to repeat contraction of muscles for 2 seconds and expansion of muscles for 2 seconds).

Figure 11:
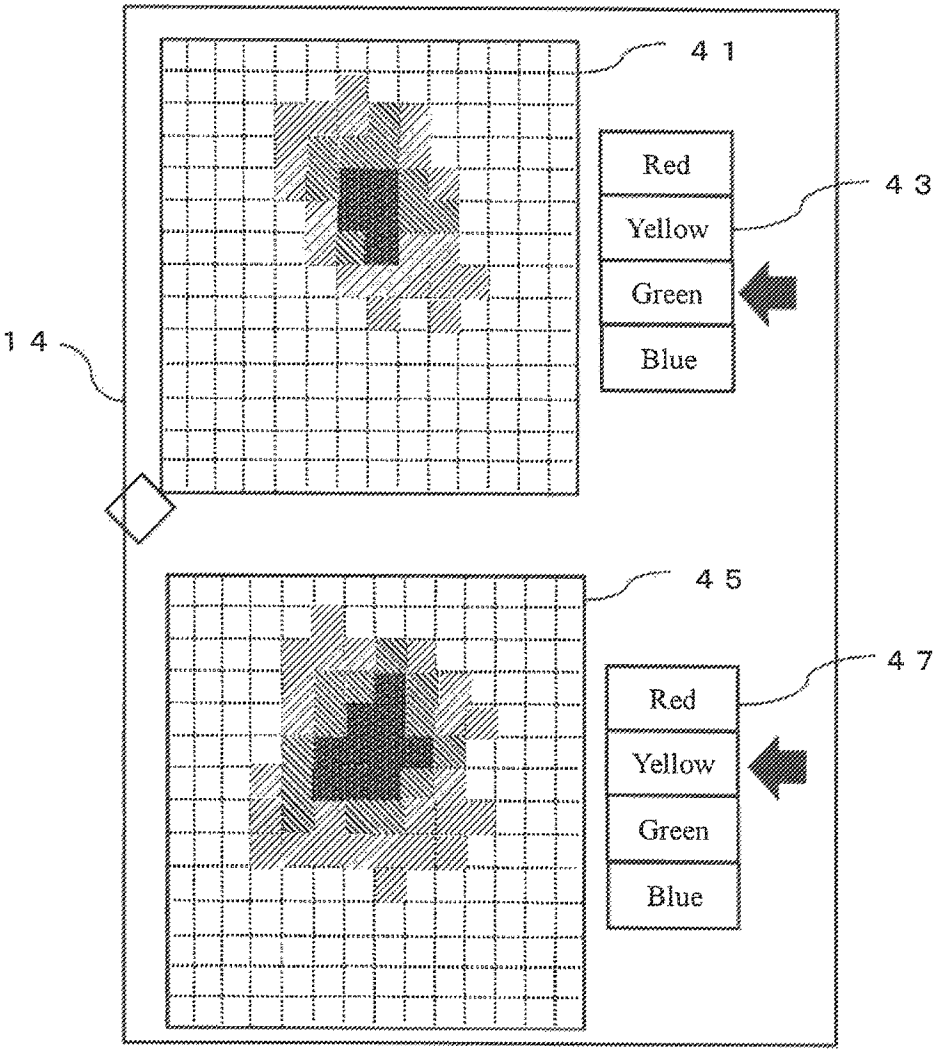
FIG. 11 illustrates an example of an image displayed by the display device.

FIG. 11 illustrates an example of an image illustrating a pressing state displayed on the display screen 14 of the display device 15.

In the example illustrated in FIG. 11, for example, a pressing force distribution image 41 and an evaluation result image 43 indicating one pressing state and a pressing force distribution image 45 and an evaluation result image 47 indicating another pressing state are displayed simultaneously so that both pressing states can be compared. One pressing state may be a pressing state of a skilled person read from the storage or may be a real-time pressing state of a present pressing treatment performed by a skilled person, for example. The other pressing state may be a real-time pressing state of a present pressing treatment performed by the user. Alternatively, one pressing state and the other pressing state may be real-time pressing states of a present pressing treatment performed by the left and right fingers of the user on different regions (for example, the left and right regions of the waist).

The pressing force distribution images 41 and 45 represent the level of the pressing force at respective positions using the density of display colors at respective positions, for example. Moreover, the evaluation result images 43 and 47 display an evaluation result with such a classification that red corresponds to the evaluation result level 4, yellow corresponds to the evaluation result level 3, green corresponds to the evaluation result level 2, and blue corresponds to the evaluation result level 1.

By providing such display, the user can learn and execute an appropriate pressing method more easily.

Such display is also helpful in studying which pressing state is more appropriate. For example, a plurality of pressing treatments with different pressed areas and/or pressing forces may be performed, and the pressing states sensed in execution of these pressing treatments may be stored in the display device 15. After that, by displaying and observing the pressing states of the respective pressing treatments stored in the display device 15 while comparing with a medical effect obtained by the respective pressing treatments, it is possible to study which pressing state provides a high medical effect.

Figure 12:
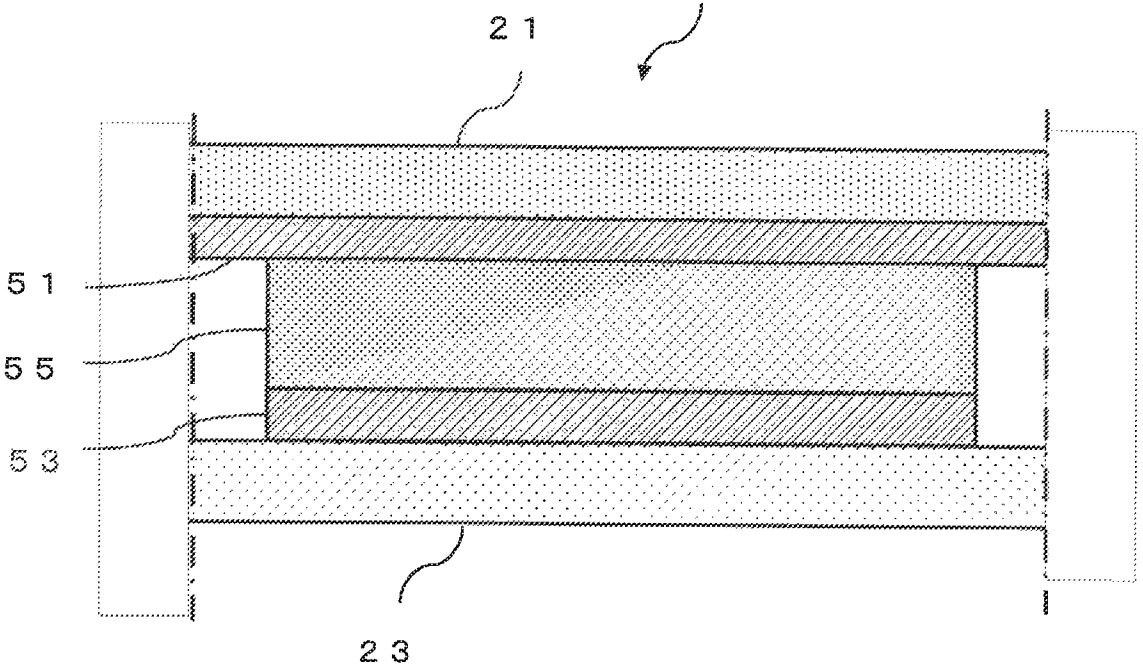
FIG. 12 illustrates a cross-section of another configuration example which may be employed in a sensor element of the system.

FIG. 12 illustrates another example of a cross-sectional structure of the sensor element 17 illustrated in FIG. 6.

As illustrated in FIG. 12, a row electrode 51 extending in the row direction is disposed on the lower surface of the upper sheet 21 of the sensor sheet 13 and a column electrode 53 extending in the column direction is disposed on the upper surface of the lower sheet 23. A pressure-sensitive electrical element (for example, a pressure-sensitive ink, a pressure-sensitive rubber or the like) 55 of which an electrical characteristic (for example, an electrical resistance or the like) changes continuously according to a pressing force applied thereto is electrically connected between the row electrode 52 and the column electrode 53. A number of row electrodes 51 and a number of column electrodes 53 corresponding to the numbers of rows and columns of the sensor elements 17 are provided in the entire sensor sheet 13. These electrodes 51 and 53 are electrically separated from each other and are connected to the signal processing device 19 illustrated in FIG. 6.

The signal processing device 19 performs a scanning operation to sequentially detect the electrical characteristics of the pressure-sensitive electrical elements 55 of a number of sensor elements 17, creates sensing data from the detection result, and transmits the sensing data to the display device 15. The display device 15 performs the control illustrated in FIG. 10, for example.

While several embodiments have been described, the description of these embodiments are illustrations for understanding the present invention, and the technical scope of the present invention is not limited to these embodiments. The present invention can be embodied in forms different from the above-described embodiments without departing from the gist thereof. For example, An assistance system according to the present invention may be applied to a pressing treatment of a type which is not based on the Kanshoho (for example, an acupressure, a massage, and other treatments that apply detectable pressing to a body, such as pressing, stroking, rubbing or massaging). For example, in the case of an acupressure, any one value within the range of several tens of kgf to 1 kgf may be employed as a reference for evaluating the pressing force, and any one value within the range of several tens of $cm^2$ to 1 $cm^2$ may be employed as a reference for evaluating the pressed area. In the case of a massage, an evaluation reference in other numerical ranges may be employed.

What is claimed is:

1. A method for causing relaxation of a muscle of a body of a person or an animal, the method comprising applying a pressing treatment sequentially to successive different spots on a skin of the body covering a certain wider region on the skin, the pressing treatment comprising:

causing the person or the animal to perform a physical exercise of expanding and contracting the muscle so that contracting the muscle is performed in a duration corresponding to approximately two heartbeats;

pressing one or more spots on a skin of the body toward the muscle under the skin with a fingertip or with a tool while the physical exercise is being performed; and controlling the fingertip or the tool to press on the respective spots so that:

an area of each of the pressed spots of the skin falls within a predetermined area range when an orientation or a position of the body changes with a movement of the muscle, a strength of a pressing force applied to each of the spots falls within a predetermined force range when the orientation or the position of the body changes with the movement of the muscle, and a position of each of the pressed spots and a direction of the pressing force are maintained to be constant when the orientation or the position of the body changes with the movement of the muscle, wherein the area range is between approximately 2 $cm^2$ and approximately 0.1 $cm^2$, the force range is between approximately 1 kgf and approximately 100 gf, and the pressing one or more spots on the skin of the body includes pressing a spot on the skin of a waist of a person toward an external oblique muscle under the skin while contracting and expanding the external oblique muscle by repeating tilting an upper-body of the person in a right-left direction.

2. The method according to claim 1, wherein the force range is between approximately 700 gf and approximately 300 gf.

3. The method according to claim 1, wherein the force range is between approximately 500 gf and approximately 300 gf.

4. The method according to claim 1, wherein the area range is between approximately 1 $cm^2$ and approximately 0.1 $cm^2$.

5. The method according to claim 4, wherein the force range is between approximately 700 gf and approximately 300 gf.

6. The method according to claim 4, wherein the force range is between approximately 500 gf and approximately 300 gf.

7. The method according to claim 1, wherein the physical exercise involves expanding the muscle for approximately 2 seconds and contracting the muscle for approximately 2 seconds.

* * * * *